US007635237B2

(12) United States Patent
Spears et al.

(10) Patent No.: US 7,635,237 B2
(45) Date of Patent: Dec. 22, 2009

(54) RETRIEVABLE SURFACE INSTALLED CATHODIC PROTECTION FOR MARINE STRUCTURES

(76) Inventors: Lenard Spears, 12540 Overlook Mountain Dr., Charlotte, NC (US) 28216; Colette Karon Netters Spears, 12540 Overlook Mountain Dr., Charlotte, NC (US) 28216

( * ) Notice: Subject to any disclaimer, the term of this patent is extended or adjusted under 35 U.S.C. 154(b) by 114 days.

(21) Appl. No.: 12/030,254

(22) Filed: Feb. 13, 2008

(65) Prior Publication Data

US 2008/0199258 A1 Aug. 21, 2008

Related U.S. Application Data

(60) Provisional application No. 60/912,957, filed on Apr. 20, 2007, provisional application No. 60/890,855, filed on Feb. 21, 2007.

(51) Int. Cl.
*E02B 17/00* (2006.01)
*C23F 13/00* (2006.01)

(52) U.S. Cl. ..... 405/211.1; 405/216; 204/196.17; 204/196.31

(58) Field of Classification Search ..... 405/211, 405/211.1, 216; 204/196.17, 196.3, 196.31
See application file for complete search history.

(56) References Cited

U.S. PATENT DOCUMENTS

| | | | | |
|---|---|---|---|---|
| 2,571,062 | A * | 10/1951 | Robinson et al. | 405/211.1 |
| 2,870,079 | A | 1/1959 | McCall | |
| 3,739,456 | A | 6/1973 | Scherer et al. | |
| 3,870,615 | A | 3/1975 | Wilson et al. | |
| 4,484,838 | A | 11/1984 | Stevens | |
| 4,484,839 | A | 11/1984 | Nandlal et al. | |
| 4,484,840 | A | 11/1984 | Nandlal et al. | |
| 4,544,465 | A | 10/1985 | Marsh | |
| 4,581,497 | A | 4/1986 | Morrison et al. | |
| 4,609,307 | A | 9/1986 | Guy et al. | |
| 4,629,366 | A | 12/1986 | Rutherford et al. | |
| 4,740,106 | A * | 4/1988 | Bianchi et al. | 405/211 |
| 6,461,082 | B1 | 10/2002 | Smith | |
| 7,138,038 | B1 * | 11/2006 | Britton et al. | 405/211.1 |

FOREIGN PATENT DOCUMENTS

| | | |
|---|---|---|
| DE | 10253417 A1 | 5/2004 |
| GB | 1567161 A | 5/1980 |
| JP | 2000087269 | 3/2000 |
| JP | 2000273666 | 10/2000 |
| JP | 2005171310 | 6/2005 |

* cited by examiner

*Primary Examiner*—Frederick L Lagman
(74) *Attorney, Agent, or Firm*—Trego, Hines & Ladenheim, PLLC

(57) ABSTRACT

An anode column for protecting a marine structure from corrosion includes: (a) an elongated guide having upper and lower ends, and adapted to be physically supported in an upright position in a body of water which overlies a seabed, independent of the marine structure; (b) an elongated conductive anode carrier surrounding the upright guide; (c) at least one sacrificial anode carried by the anode carrier and; and (b) an electrical conductor extending from the column and adapted to be connected to the marine structure at a location accessible from a surface of the body of water, wherein the at least one anode is electrically connected to the conductor through the anode carrier. A method is provided for installing the anode column from the surface.

25 Claims, 11 Drawing Sheets

RETRIEVABLE SURFACE INSTALLED CATHODIC PROTECTION FOR MARINE STRUCTURES

CROSS-REFERENCE TO RELATED APPLICATIONS

This application claims the benefit of Provisional Application Ser. No. 60/890,855, filed Feb. 21, 2007, and Provisional Application Ser. No. 60/912,957 Filed Apr. 20, 2007.

BACKGROUND OF THE INVENTION

This invention relates generally to marine structures, and more particularly to a cathodic protection system for controlling corrosion of such structures.

Known marine structures such as oil and gas structures typically include a platform which is supported above sea level by an arrangement of steel legs anchored on or driven into the sea bed, and coupled together by steel truss members. If unprotected, seawater will rapidly corrode such steel structures.

Accordingly, it is well known to apply cathodic protection to steel marine structures by providing sacrificial anodes, for example of aluminum or zinc, which are electrically coupled to the steel structure. The anodes preferentially corrode to produce an electrical current that protects the steel structure from corrosion.

Often the sacrificial anodes take the form of many individual masses which are attached directly to the legs and/or truss members of the structure. Installation of such anodes, or replacement at the end of their useful life, requires the efforts of a diver. Offshore structures may be set in waters far beyond the practical diver working depth of about 91 m (300 ft.), for example about 366 m (1200 ft.). Maintenance or replacement of anodes at such depths requires the use of underwater remotely operated vehicles (ROVs), which are very expensive.

It is also known that sacrificial anodes can be configured in a vertical column supported by the marine structure, similar to a tubing string. These columns are configured to be attached to the marine structure using special brackets. By attaching the columns, additional weight is added to the marine structure and there is a limit to the number of columns that can be physically installed. Furthermore, this type of column may not be suitable for retrofit situations where the marine structure was not designed to carry the weight of the anodes, and where the specific brackets needed to attach a vertical anode column were not included in the initial construction of the marine structure.

BRIEF SUMMARY OF THE INVENTION

These and other shortcomings of the prior art are addressed by the present invention, which according to one aspect provides an anode column for protecting a marine structure from corrosion, including: (a) an elongated guide having upper and lower ends, and adapted to be physically supported in an upright position in a body of water which overlies a seabed, independent of the marine structure; (b) an elongated conductive anode carrier surrounding the upright guide; (c) at least one sacrificial anode carried by the anode carrier and; and (b) an electrical conductor extending from the column and adapted to be connected to the marine structure at a location accessible from a surface of the body of water. The at least one anode is electrically connected to the conductor through the anode carrier.

According to another aspect of the invention, a cathodically protected apparatus includes: (a) a marine structure disposed in a body of water which overlies a seabed, the marine structure including at least one corrodable metallic member submerged below a surface of the body of water; and (b) at least one anode column, including: (i) an elongated guide having upper and lower ends, the guide being physically supported in an upright position in the body of water, independently from the marine structure; (ii) an elongated conductive anode carrier surrounding the upright guide; (iii) at least one sacrificial anode carried by the anode carrier; and (iv) an electrical conductor extending from the anode column and connected to the marine structure at a location accessible from the surface, such that the at least one anode is electrically connected to the conductor through the anode carrier.

According to another aspect of the invention, a method of installing an anode column for protecting a marine structure includes: (a) positioning an elongated guide having upper and lower ends in a body of water which overlies a seabed, such that the guide is supported independently of the marine structure; (b) placing an elongated conductive anode carrier which has at least one sacrificial anode secured thereto over the guide, so it surrounds the guide; and (c) connecting an electrical conductor between the anode column and the marine structure.

BRIEF DESCRIPTION OF THE DRAWINGS

The invention may be best understood by reference to the following description taken in conjunction with the accompanying drawing figures in which:

FIG. 11 is a schematic side view of a marine structure installed in a body of water with several anode columns installed nearby;

DETAILED DESCRIPTION OF THE INVENTION

Figure 1:
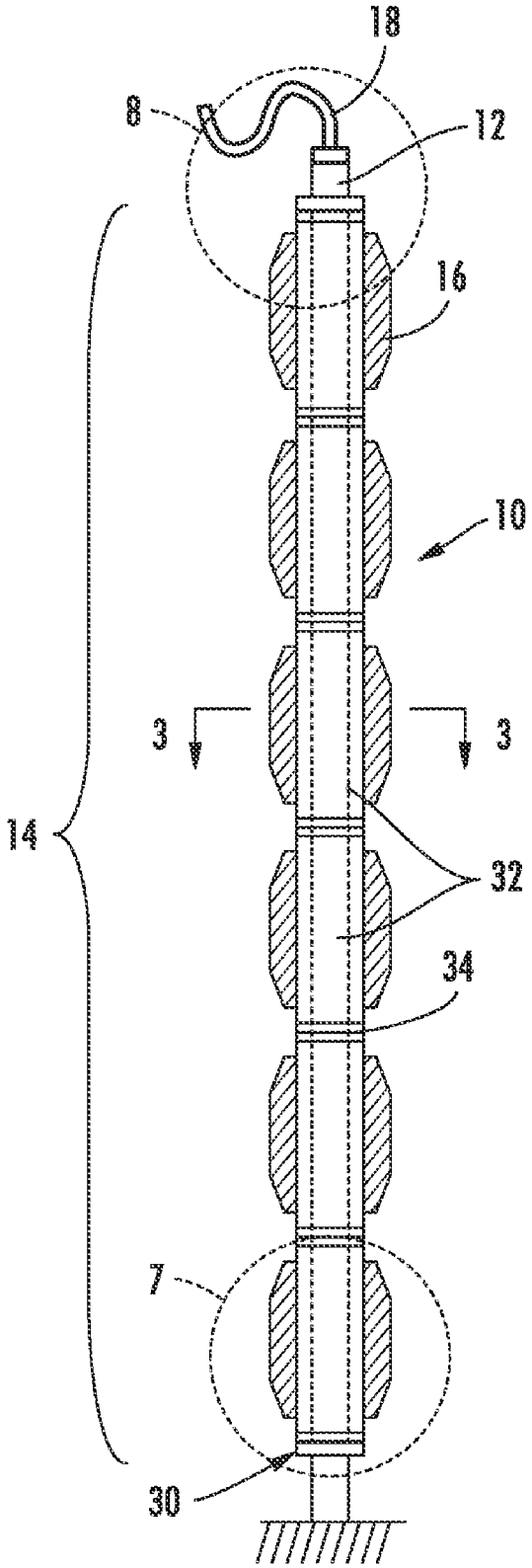
FIG. 1 is a partially-sectioned side view of an exemplary anode column constructed according to an aspect of the present invention.
Figure 2:
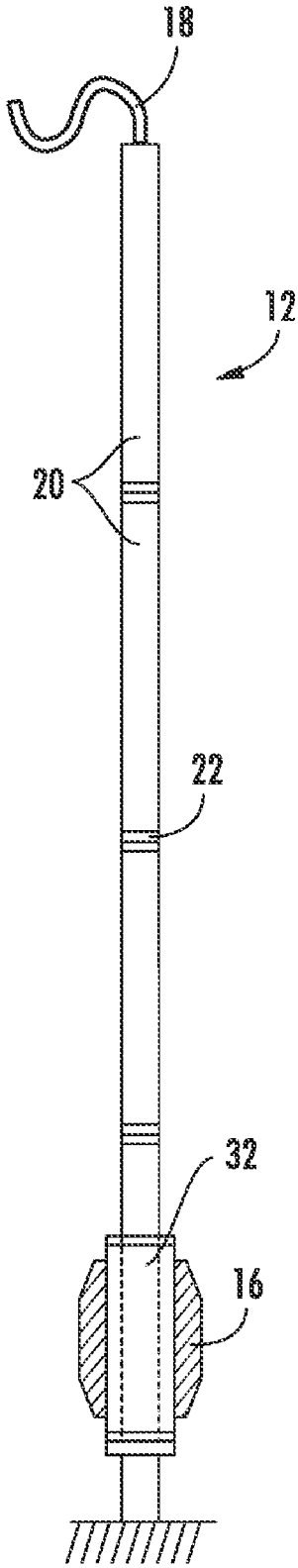
FIG. 2 is another side view of the anode column of FIG. 1 with some of the components removed to reveal a central guide thereof.
Figure 3:
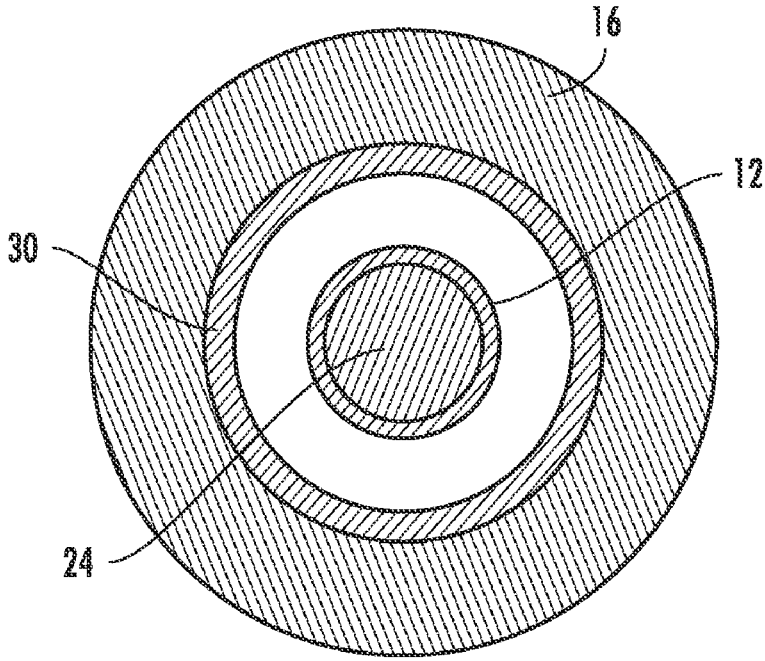
FIG. 3 is a view taken along lines 3-3 of FIG. 1.

Referring to the drawings wherein identical reference numerals denote the same elements throughout the various views, FIGS. 1-3 illustrate an exemplary anode column 10 constructed according to an aspect of the present invention.

The basic components of the anode column 10 are a guide 12, an elongated anode string 14 which includes sacrificial anodes 16, and an electrical conductor 18.

The guide 12 is a vertically-elongated, tube-like member. The guide 12 may be constructed from a plurality of steel pipe guide sections 20 which are joined to each other at threaded connections 22 of a known type. In the illustrated example, the pipe inner diameter is about 7.62 cm (3 in.). The size is not critical and may be varied to suit a particular application. The interior of the guide 12 may be filled with cement 24, expanding foam, or a similar material to stiffen and stabilize the guide 12. The primary functions of the guide 12 are to provide structural support and a means for guiding installation and removal of the anode string 14, as described in more detail below. Accordingly, while the guide 12 is depicted as having a circular cross-section, the specific cross-sectional shape is not critical, and other shapes such as a polygon, or solid or lobed cross-sectional shapes could be substituted. Furthermore, any type of joint, for example threads, mechanical fasteners or welding, may be used between the guide sections 20 so long as the joint retains them together securely.

Figure 4:
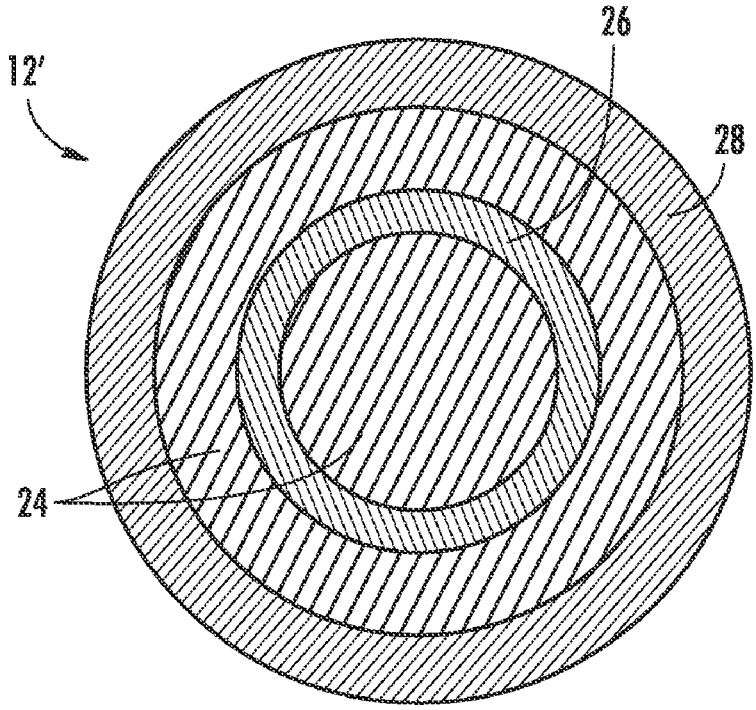
FIG. 4 is a cross-sectional view of an alternative central guide.

While FIG. 3 depicts the guide 12 as a single-walled structure, it is possible that it could comprise multiple walls. For example, FIG. 4 illustrates an alternative guide 12' having an inner wall 26 and an outer wall 28 which cooperatively define two spaces, either or both of which that may be filled with cement 24, expanding foam, or a similar material to form a strong composite structure.

The anode string 14 comprises an anode carrier 30 and sacrificial anodes 16. Like the guide 12, the anode carrier 30 is a vertically-elongated, tube-like member. In the illustrated example, the anode carrier 30 may be constructed from a plurality of steel pipe carrier sections 32 which are joined to each other at threaded connections 34 of a known type. As shown, the pipe inner diameter is about 10.2 cm (4 in.). The size is not critical and may be varied to suit a particular application. The anode carrier 30 need only be sized and shaped to fit over and surround the guide 12. Accordingly, while the anode carrier 30 is depicted as having a circular cross-section, the cross-sectional shape is not critical, and other shapes such as a polygon or a lobed cross-sectional shape could be substituted. Furthermore, any type of joint, such as threads, mechanical fasteners, or welding, may be used between the carrier sections 32.

Figure 5:
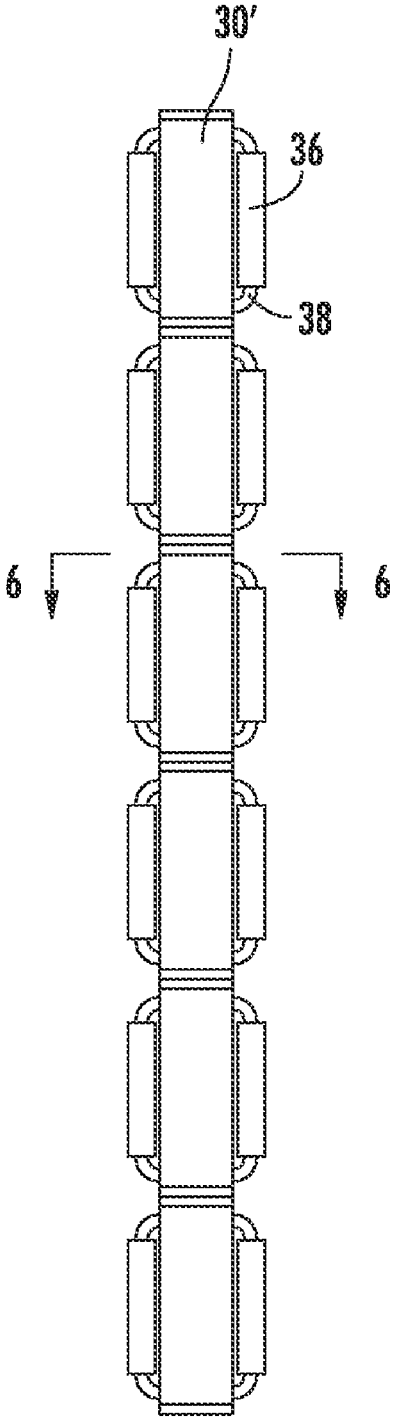
FIG. 5 is a side view of an alternative anode carrier.
Figure 6:
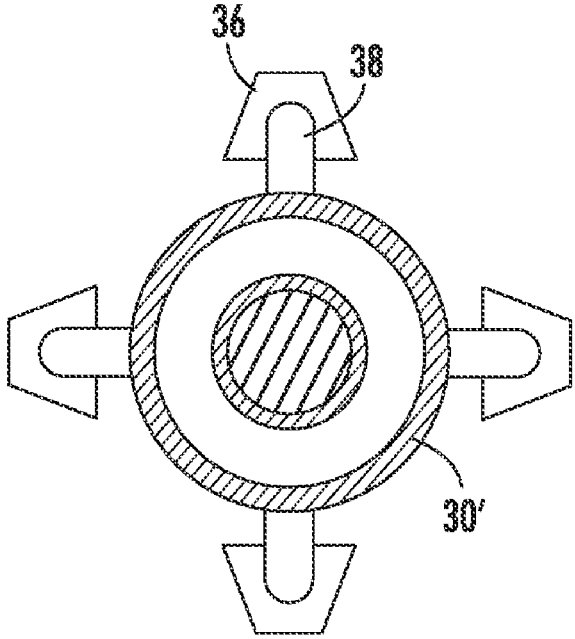
FIG. 6 is a view taken along lines 6-6 of FIG. 5.

The sacrificial anodes 16 comprise a material which is anodic to steel, such as aluminum, magnesium, or zinc. In the example shown in FIGS. 1-3, the anodes 16 are cast or otherwise fabricated into generally cylindrical shapes, and are secured to the outer surface of the anode carrier 30, for example by being shrunk thereon or by mechanical fasteners. FIGS. 5 and 6 illustrate an alternative anode carrier 30'. Bars 36 of sacrificial material are shrunk onto steel tubes 38 which are welded, bolted, or otherwise secured to the outer surface of the anode carrier 30'. It will be understood that neither the specific physical configuration of the sacrificial material nor its method of attachment to the anode carrier 30 is critical, so long as the sacrificial material is mechanically supported and an electrically conductive path is provided to the guide 12. For purposes of descriptive simplicity only, the installation and use of the anode columns 10 will be further described with the configuration of sacrificial material shown in FIG. 1.

One or both of the upper and lower ends of the anode string 14 may be secured to the guide 12 so that the guide 12 can provide structural support and an electrical conduction path to a protected structure.

Figure 7A:
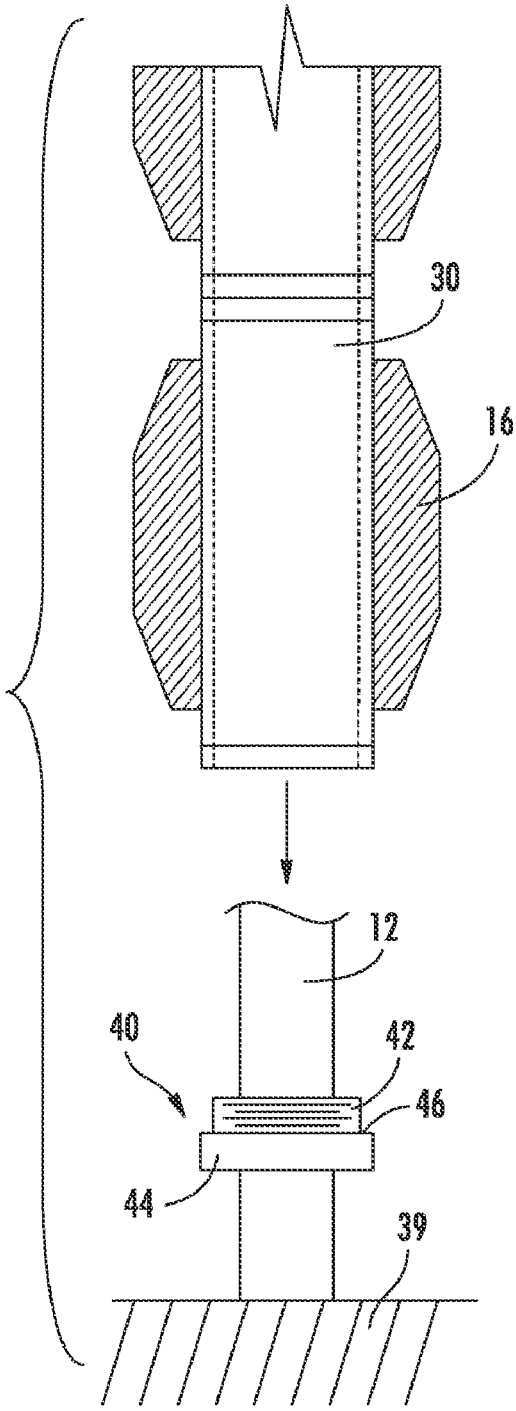
FIG. 7A is an exploded side of a portion of the anode column shown in FIG. 1, showing a connection of a lower portion of an anode carrier to a central guide.

FIG. 7A illustrates how the lower end of the anode string 14 may be attached to the guide 12, which is in turn secured to an anchorage (shown schematically at 39). A fitting 40 is attached to the guide 12. This takes the form of an annular component having upper and lower sections 42 and 44 of different diameters, such that a step 46 is defined. The upper section 42 is sized to fit inside of the anode carrier 30, while the lower section 44 is sized so that the anode carrier 30 sits on top of it. This prevents the anode carrier 30 from dropping below a predetermined height above the seabed when installed. The upper section is 42 externally threaded and the bottom-most section of the anode carrier 30 would be screwed thereto. Standard hardware such as "go/no-go" fittings or threaded collets may be used for this purpose as well.

Figure 7B:
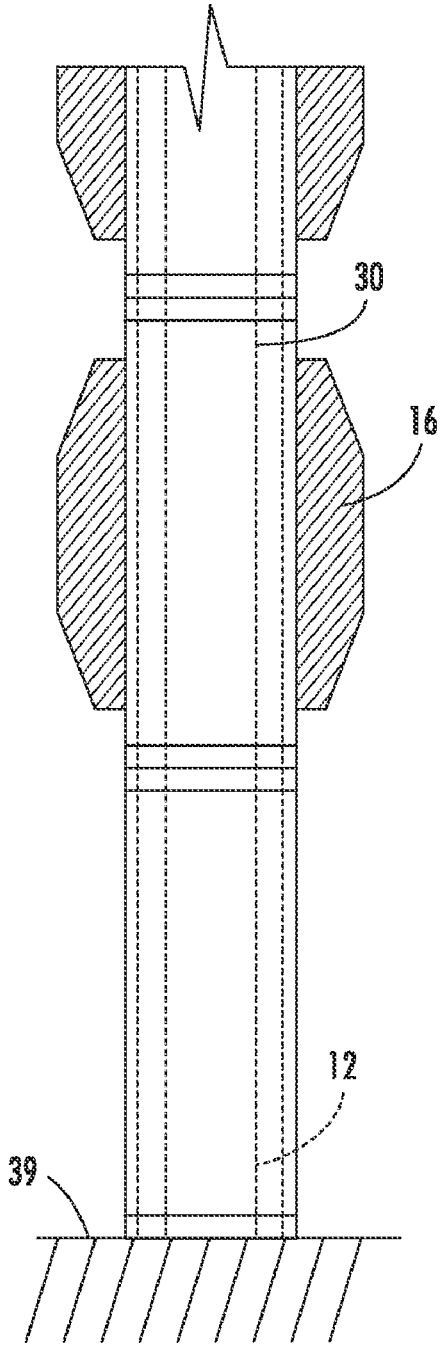
FIG. 7B is a side view of a portion of an anode column showing an alternative configuration of the lower portion of the anode carrier.

Alternatively, the lower end of the anode string 14 may be attached directly to the anchorage 39, as shown in FIG. 7B. In this configuration, a base fitting 41 is provided which is like one of the carrier sections 32 of the anode carrier 30. The remainder of the anode carrier 30 may then be joined to the base fitting 41 in the same manner that the carrier sections 32 are attached to each other, e.g. by a threaded joint.

In order to permit easy disassembly for inspection, maintenance, or replacement, means are provided for selective disconnection of the lower end of the anode carrier 30 from the guide 12 or the base fitting 41. This could be accomplished by using left-hand threads on the connection between the guide 12 or base fitting 41 and the anode carrier 30 (where the joints between the carrier sections 32 have right-hand threads), by using a low-torque threaded joint so that the connection of the lower end of the anode carrier 30 can be unscrewed from the guide 12 or base fitting 41 without separating the carrier sections 32, or the like.

Figure 8:
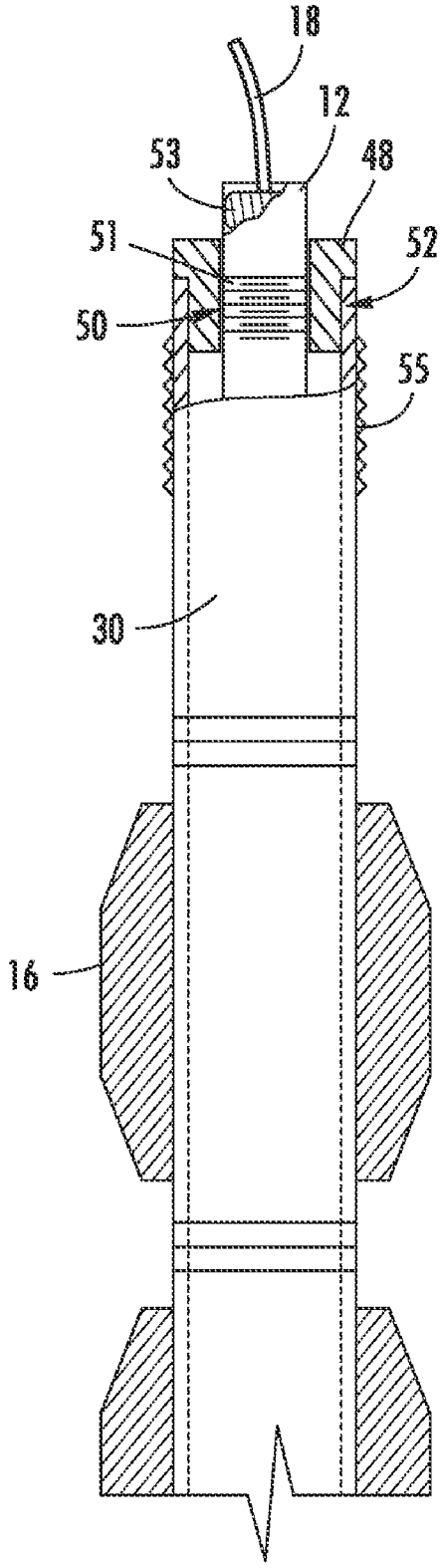
FIG. 8 is another exploded side of a portion of the anode column shown in FIG. 1, showing a connection of an upper portion of an anode carrier to a central guide.

FIG. 8 illustrates one method by which the upper end of the anode string 14 may be attached to the guide 12. An annular hanger 48 has a threaded inner bore 50 which is connected to a threaded portion 51 of the uppermost section of the guide 12, and a threaded outer wall 52 that is connected to the uppermost section of the anode carrier 30. Other types of hardware such as threaded collets may be used for this purpose as well. The uppermost section of the anode carrier 30 may be provided with a coupling structure such as external threads 55 (e.g. left-hand threads) in order to facilitate removal of the anode carrier 30 without disturbing As shown in FIG. 8, the conductor 18 is mechanically and electrically connected to the guide 12, for example by a braze joint 53, a swage, mechanical fasteners, or the like. In this example, a conduction path is provided from the anodes 16 through the conductive anode carrier 30, the conductive hanger 48, the conductive guide 12, and finally to the conductor 18. However, other configurations may be used so long as a conduction path is provided from the anodes 16 to the conductor 18.

Figure 9:
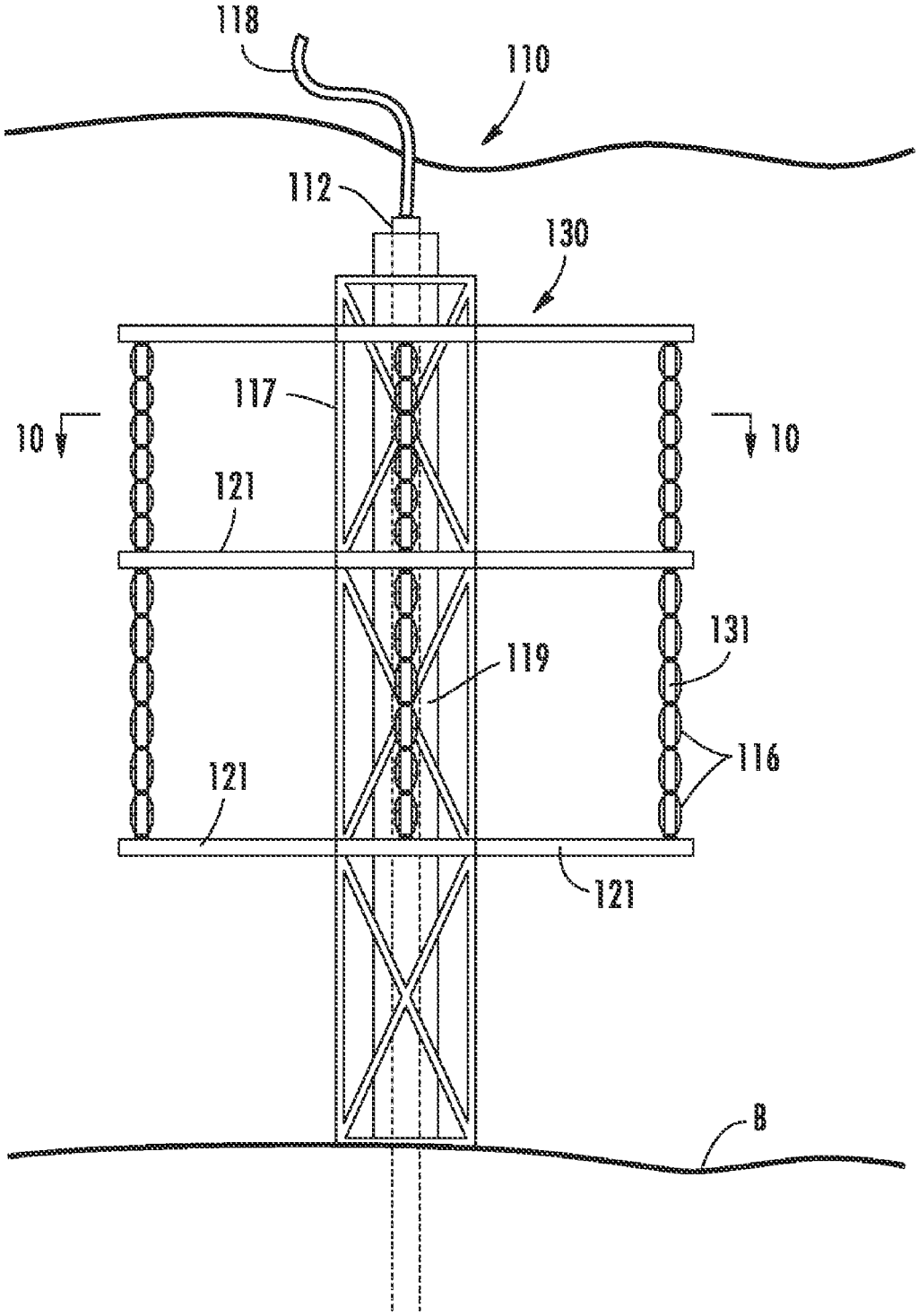
FIG. 9 is a side view of an alternative anode column configuration
Figure 10:
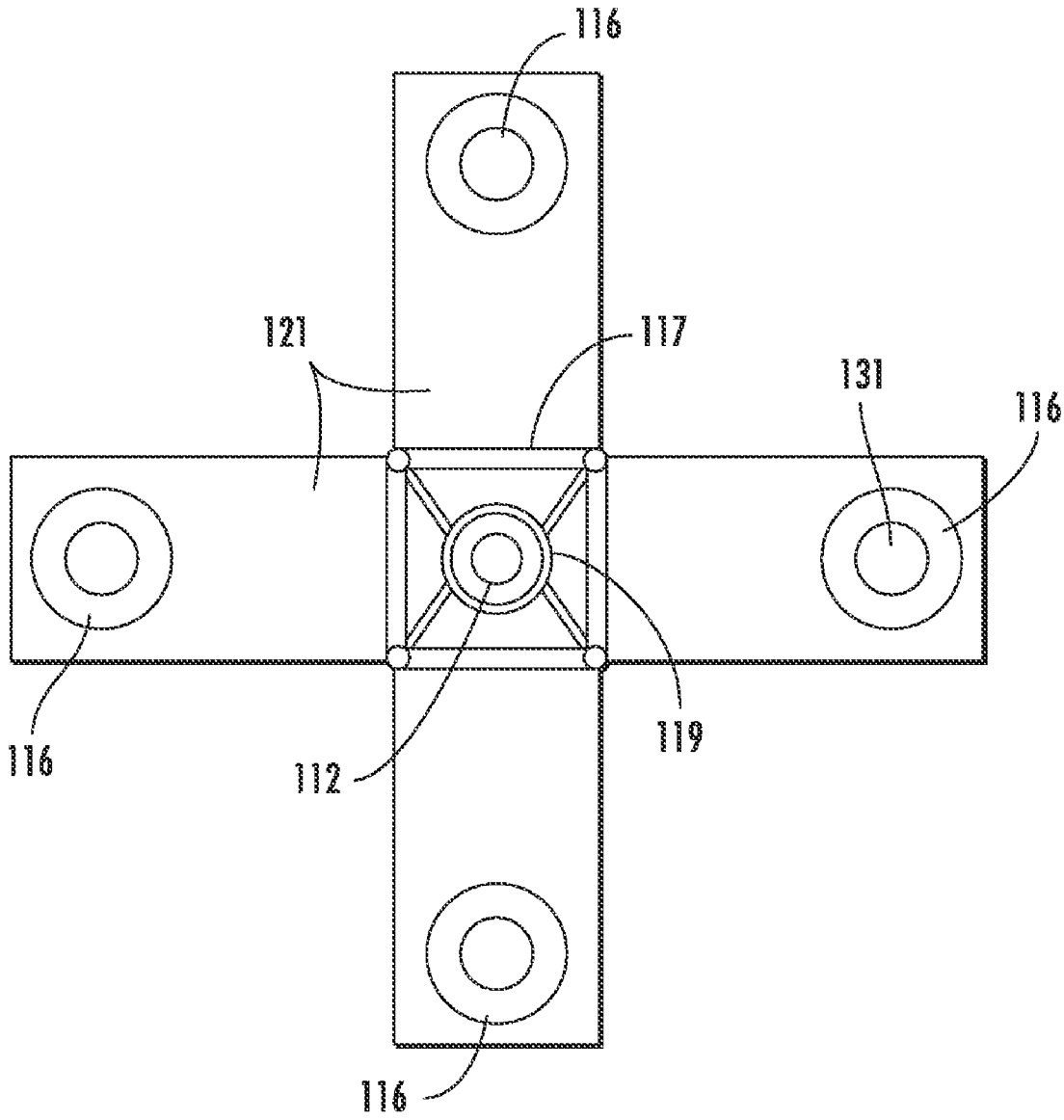
FIG. 10 is a view taken along lines 10-10 of FIG. 9.
Figure 17:
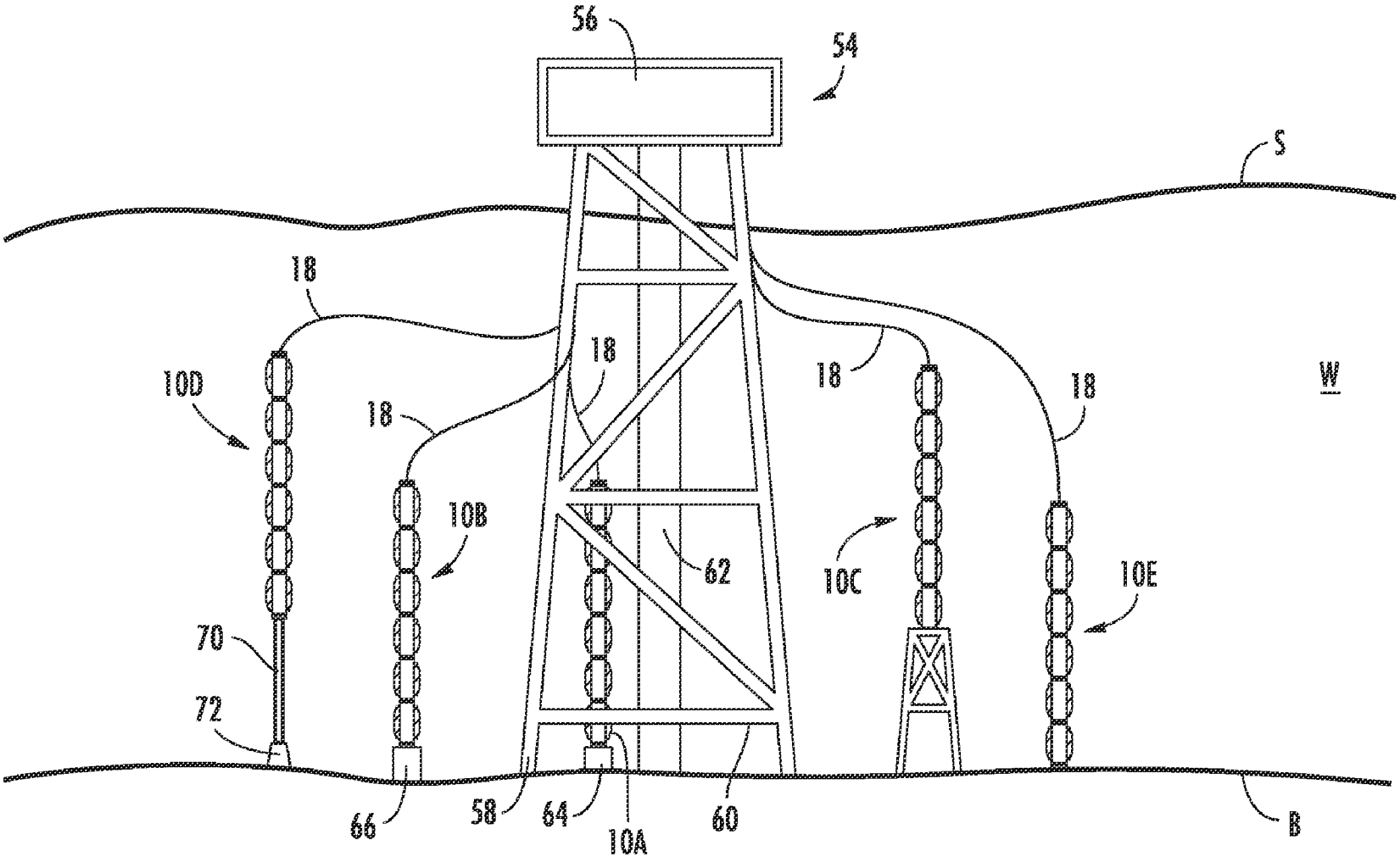

FIGS. 9 and 10 illustrate an alternative anode column 110. Like the anode column 10, it includes a central guide 112 anchored into the seabed B or otherwise supported in an upright position, and a plurality of sacrificial anodes 116. Instead of a single tube, the carrier 130 comprises a tower 117 having an open truss construction to reduce water drag forces. A pipe 119 of relatively small diameter is disposed in the center of the tower 117 and serves to locate the tower 117 on the guide 112. A plurality of arms 121 extend out laterally from the tower. As illustrated, the arms 121 take the form of flat plates, but other shapes such as I-beams may be used. The tower 117 may include several vertically spaced-apart levels of arms 121, as shown. One or more upright columns 131, similar in construction to the carriers 30 described above, extend between the arms 121. The anodes 116 are attached to the columns 131. A conductor 118 connects the anode column 110 to a protected marine structure (not shown) This configuration allows increased density of anode placement using a single guide.

FIG. 11 illustrates how a marine structure may be protected by one or more of the anode columns described above. In this example, the structure is a drilling rig 54 erected in a body of water W, such as the ocean. A platform 56 is supported by a plurality of metallic legs 58 that are driven into the seabed B below the body of water W and interconnected by metallic truss members 60. One or more drill strings 62 extend downward from the platform 56 to the seabed B. Substantial portions of the drilling rig 54 are constructed from ferrous alloys and are thus subject to rapid corrosion in seawater.

While a drilling rig 54 is illustrated, any marine structure may be provided with cathodic protection using the principles of the present invention. The protected structure could be permanently mounted in the seabed, as in the case of the drilling rig 54, or it could be free-floating, or it could be floated on anchored spars in a known manner.

One or more anode columns 10, constructed as described above, are placed in convenient proximity to the drilling rig 54. Each anode column 10 is structurally supported independently from the drilling rig 54 and electrically connected to the drilling rig 54 via an electrical conductor 18, such as the illustrated cables. Known methods may be used to compute the total mass of sacrificial material required to protect a specific structure, and this sacrificial material may be distributed among as many anode columns as desired. FIG. 11 is merely intended as an example of the different kinds of possible installation configurations, and greater or fewer anode columns 10 may be used in a particular application. As illustrated, a first anode column 10A is placed on a piling 64 driven into the seabed B within the perimeter defined by the legs 58. A second anode column 10B is placed on a piling 66 driven into the seabed B outside the drilling rig 54. A third anode column 10C is mounted on a truss structure 68 which is placed on or driven into the seabed B. This configuration may be used to elevate the anode column 10C a substantial distance above the seabed B when desired. For example, this may be necessary if the seabed B is at a depth that might cause crushing of the anode column 10C.

A fourth anode column 10D is configured as a "spar" structure. The inner guide and/or the anode carrier thereof are sealed and partially evacuated to provide buoyancy. The anode column 10D is connected to an anchor 70 by a tether 72 (e.g. a heavy cable or chain).

Figure 12:
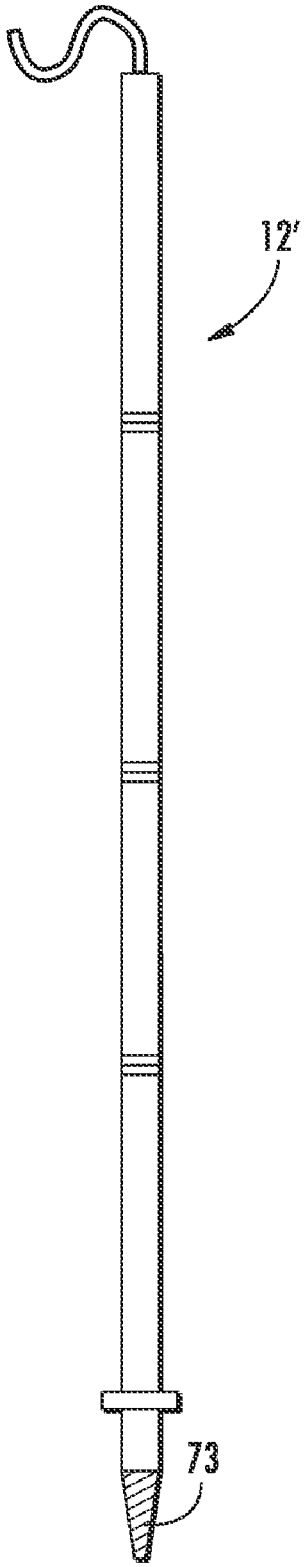
FIG. 12 is a side view of an alternative guide incorporating an auger at a lower end thereof.

A fifth anode column 10E is directly mounted to the seabed B. This may be accomplished by using a guide 12' (see FIG. 12) with an auger 73 or other type of cutting tip suitable for cutting into the seabed B during installation. If a configuration such as that shown in FIG. 7B is used to anchor the anode column 10E, the auger or cutting tip could be attached to the anode carrier 30.

Figure 13:
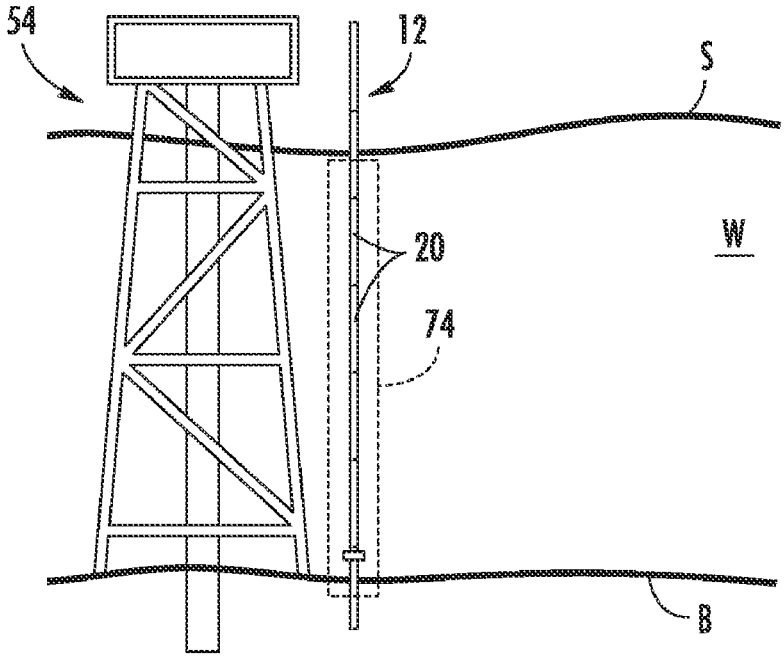
FIG. 13 is a schematic side view illustrating the process of installing an anode column near a marine structure.

The anode column 10 is configured so that it may be easily installed or removed from a surface location with minimal or no use of divers or ROVs. The basic installation process is as follows, with reference to FIGS. 13-15:

First, the guide 12 is set in place. This may be done by connecting the guide sections 20 in a bottom-to-top sequence and lowering the guide 12 towards the seabed B as it is built up. This step is similar to the known manner in which conventional well drill strings are built up. Additional temporary pipe sections may be added to the top end of the guide 12 as needed to provide sufficient height to reach the seabed B and allow driving force to be applied thereto. The installed guide 12 is shown in FIG. 13. The guide 12 is supported in such a way as to remain upright during use, for example using one of the structures shown in FIG. 9. Preferably, the guide 12 is supported or anchored in such a way that is can be set completely from the surface S, for example, the guide 12 may be driven into the seabed B in the manner of a conventional piling, or screwed in if an auger 73 or similar type of cutting tip is used.

Figure 14:
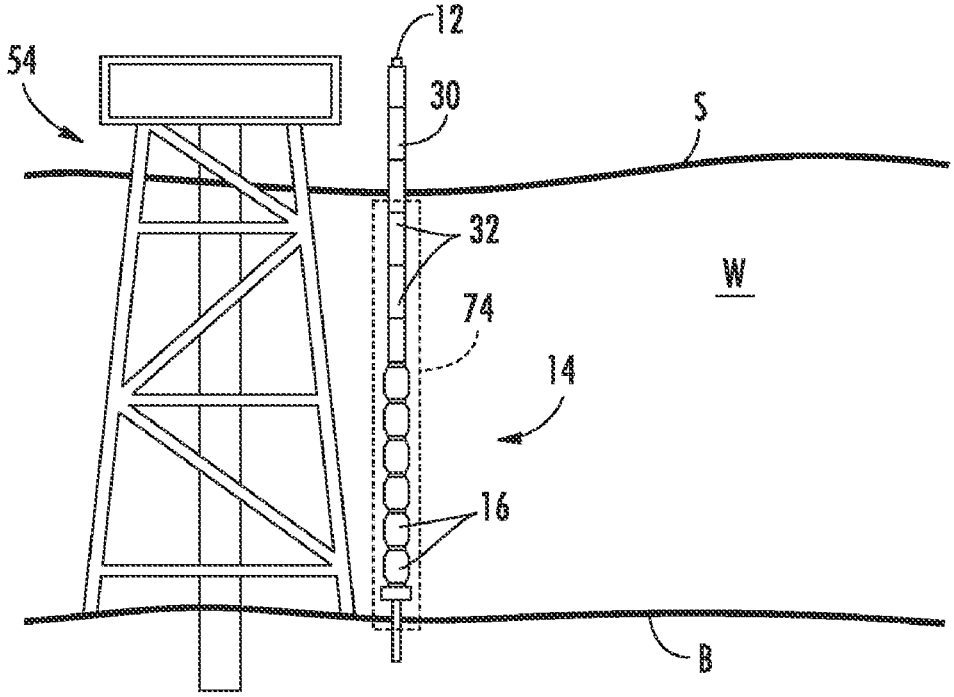
FIG. 14 is a schematic side view illustrating another portion of the process of installing an anode column near a marine structure.

Next, the anode string 14 is installed. This may be done by connecting the carrier sections 32 in a in a bottom-to-top sequence and lowering the guide towards the seabed B, as it is built up. This step is similar to the known manner in which conventional well drill strings are built up. Additional temporary pipe sections may be added to the top end of the anode carrier 30 as needed to provide sufficient height to reach the seabed B. Once in place, the anode carrier 30 is connected at one or both of its upper and lower ends to the guide 12, so that the guide 12 can provide structural support and an electrical pathway. As shown in FIG. 7B, the lower end of the anode carrier 30 could be anchored directly to the seabed B rather than being secured to the guide 12. The installed anode carrier 30 is shown in FIG. 14.

Figure 15:
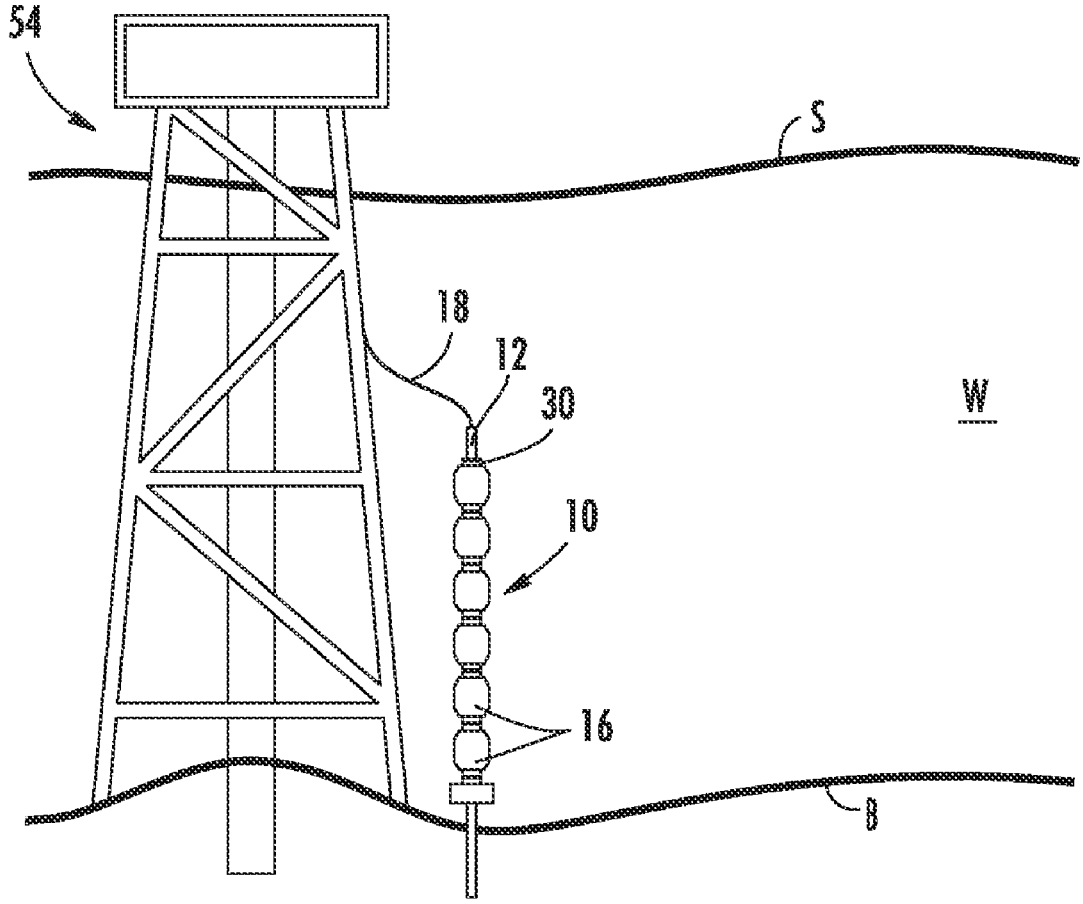
FIG. 15 is a schematic side view illustrating a final portion of the process of installing an anode column near a marine structure.

Once the guide 12 and anode carrier 30 are installed, any extra pipe sections are removed, and an electrical conductor 18, such as the cable shown in FIG. 15, is connected between the guide 12 and the marine structure 54. For practical purposes, the conductor 18 may be connected to the uppermost guide section 20 before it is lowered into the water. A junction box (not shown) or other appropriate hardware may be provided on the marine structure for this purpose. Once connected, a conduction path is present from the anodes 16 to the marine structure 54. Using known electrical equipment such as an ammeter or voltmeter, the electrical performance of the anode column 10 can be checked and verified.

In some cases, there may be subsurface currents which place substantial forces on the anode column 10. In such cases, an external guide 74, shown in dashed lines in FIGS. 13 and 14 may be erected to protect the anode column 10 during assembly. The external guide 12 may simply be a large-diameter pipe in one or more sections, and is removed after installation is complete. If the external guide 74 is used, a portion of it may be left in place to serve as an anchoring structure for the anode column 10. For example, a portion of the external guide 74 may be used to serve as the base fitting 41 described above.

The exact sequence of installation is not critical, and may variations are possible. For example, the guide 12 and the anode string 14 may be made up and installed simultaneously rather than installing the guide 12 first.

The configuration of the anode column 10 allows easy surface access if repair or maintenance is required after installation. For example, when the anodes 16 reach the end of their useful life, they may be replaced by extending pipe sections down to the anode string 14, connecting them to the anode carrier 30, disconnecting the anode carrier 30 from the guide 12, and hauling the anode carrier 30 to the surface. The anodes 16 may then be replaced and the anode carrier 30 reinstalled, or new anode carrier sections 32 may be provided. All of these steps are performed while the guide 12 and conductor 18 remain in place, providing a means to pilot the movement of the anode carrier 30, again minimizing the amount of diver or ROV intervention required.

The foregoing has described a method and apparatus for cathodic protection of marine structures. While specific embodiments of the present invention have been described, it will be apparent to those skilled in the art that various modifications thereto can be made without departing from the spirit and scope of the invention. Accordingly, the foregoing description of the preferred embodiments of the invention and the best mode for practicing the invention are provided for the purpose of illustration only.

What is claimed is:

1. An anode column for protecting a marine structure from corrosion, comprising:

(a) an elongated guide having upper and lower ends, and adapted to be physically supported in an upright position in a body of water which overlies a seabed, independent of the marine structure, the guide comprising a plurality of sections connected in an end-to-end arrangement;

(b) an elongated conductive anode carrier surrounding the upright guide;

(c) at least one sacrificial anode carried by the anode carrier and; and (d) an electrical conductor extending from the column and adapted to be connected to the marine structure at a location accessible from a surface of the body of water, wherein the at least one anode is electrically connected to the conductor through the anode carrier.

2. The anode column of claim 1 wherein the guide is adapted to be anchored to the seabed, and the anode carrier is secured to the guide.

3. The anode column of claim 1 wherein the anode carrier is adapted to be anchored to the seabed.

4. The anode column of claim 1 wherein a lower end of the column is adapted to be anchored to the seabed.

5. The anode column of claim 2 wherein a lower end of the column includes a cutting tip adapted to be driven into the seabed.

6. The anode column of claim 1 wherein a lower end of the column is mounted on a truss structure adapted to be set on the seabed.

7. The anode column of claim 1 wherein the guide and the anode carrier form a buoyant structure adapted to be connected to an anchor on the seabed.

8. The anode column of claim 1 wherein at least a portion of the guide is conductive and the at least one anode is electrically connected to the conductor through the anode carrier and the guide.

9. The anode column of claim 1 wherein the at least one anode is secured directly to an outer surface of the anode carrier.

10. the anode column of claim 1 wherein the at least one anode is secured to a metallic tube which is in turn secured to an outer surface of the anode carrier.

11. The anode column of claim 1 wherein the anode carrier comprises a plurality of carrier sections connected in an end-to-end arrangement.

12. The anode column of claim 11 wherein at least one end of the anode carrier is secured to the guide with a joint that can be separated without separating the carrier sections from one another.

13. The anode column of claim 1 wherein the guide comprises a peripheral wall, and an interior space defined by the wall is filled with a material of a different composition from that of the peripheral wall.

14. The anode column of claim 1 wherein the guide comprises two or more generally concentric peripheral walls which cooperatively define at least two separate interior spaces.

15. The anode column of claim 14 wherein at least one of the interior spaces is filled with a material of a different composition from that of the peripheral walls.

16. The anode column of claim 1 wherein the carrier comprises:

(a) an upright pipe surrounding the guide;

(b) an open tower structure connected to the upright pipe;

(c) at least one arm extending laterally outward from the tower; and (d) at least one upright column carried by the arm, wherein the at least one anode is secured to the at least one column.

17. A cathodically protected apparatus, comprising:

(a) a marine structure disposed in a body of water which overlies a seabed, the marine structure including at least one corrodable metallic member submerged below a surface of the body of water; and (b) at least one anode column, comprising:

(i) an elongated guide having upper and lower ends, the guide being physically supported in an upright position in the body of water, independently from the marine structure, the guide comprising a plurality of sections connected in an end-to-end arrangement;

(ii) an elongated conductive anode carrier surrounding the upright guide;

(iii) at least one sacrificial anode carried by the anode carrier; and (iv) an electrical conductor extending from the anode column and connected to the marine structure at a location accessible from the surface, such that the at least one anode is electrically connected to the conductor through the anode carrier.

18. A method of installing an anode column for protecting a marine structure, comprising:

(a) positioning an elongated guide having upper and lower ends in a body of water which overlies a seabed, such that the guide is supported independently of the marine structure, wherein the guide comprises a plurality of guide sections, and the guide is positioned by connecting the guide sections in an end-to-end arrangement as the guide is lowered from a surface of the body of water;

(b) placing an elongated conductive anode carrier which has at least one sacrificial anode secured thereto over the guide, so it surrounds the guide; and (c) connecting an electrical conductor between the anode column and the marine structure.

19. The method of claim 18 further comprising driving the guide into the seabed.

20. The method of claim 18 wherein the anode column has a cutting tip disposed at a lower end thereof, further comprising the step of screwing the cutting tip into the seabed.

21. The method of claim 18 wherein a lower end of the anode carrier is connected to the guide by a fitting carried by the guide.

22. The method of claim 18 wherein the anode carrier comprises a plurality of carrier sections, and the step of positioning the guide includes connecting the carrier sections in an end-to-end arrangement as the guide is lowered from a surface of the body of water.

23. The method of claim 22 wherein a lower end of the anode carrier is connected to the guide such that the anode carrier can be separated from the guide by forces applied at an upper end of the anode carrier without separating the carrier sections from one another.

24. The method of claim 18 further comprising:

(a) anchoring the guide to the seabed; and (b) securing a lower end of the anode carrier to the guide.

25. The method of claim 18 further comprising anchoring a lower end of the anode carrier to the seabed.

* * * * *